US009888716B2

(12) United States Patent
Adams et al.

(10) Patent No.: US 9,888,716 B2
(45) Date of Patent: Feb. 13, 2018

(54) COIL PACKAGING FOR SMOKELESS TOBACCO

(71) Applicant: Philip Morris USA Inc., Richmond, VA (US)

(72) Inventors: John M. Adams, Mechanicsville, VA (US); Tommy C. Holland, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 496 days.

(21) Appl. No.: 14/669,665

(22) Filed: Mar. 26, 2015

(65) Prior Publication Data

US 2015/0196054 A1 Jul. 16, 2015

Related U.S. Application Data

(60) Division of application No. 12/791,658, filed on Jun. 1, 2010, now Pat. No. 9,010,336, which is a (Continued)

(51) Int. Cl.
*A24B 15/28* (2006.01)
*A24F 23/02* (2006.01)
(Continued)

(52) U.S. Cl.
CPC ..... *A24F 23/02* (2013.01); *A24B 13/00* (2013.01); *A24F 23/00* (2013.01); *B65B 13/02* (2013.01);
(Continued)

(58) Field of Classification Search
None
See application file for complete search history.

(56) References Cited

U.S. PATENT DOCUMENTS 2,569,140 A 9/1951 Avery
5,133,980 A 7/1992 Ream et al.
(Continued)

FOREIGN PATENT DOCUMENTS

GB 1350740 A 4/1974
SE WO 2004095959 A1 * 11/2004 ..... A24B 13/00
(Continued)

OTHER PUBLICATIONS

International Search Report and Written Opinion issued Mar. 28, 2011 in corresponding Application PCT/EP2010/006195.
(Continued)

*Primary Examiner* — Michael H Wilson
*Assistant Examiner* — Phu Nguyen
(74) *Attorney, Agent, or Firm* — Buchanan Ingersoll & Rooney PC

(57) ABSTRACT

A pocket sized dispenser houses in coiled form a flexible strip of portions of smokeless tobacco sized for placement between a consumer's cheek and gum, where the flexible strip includes a base tape removably attached to the plurality of portions, and wherein the dispenser and strip are adapted to allow a consumer to separate individual portions from the base tape. The individual portions comprise either a collection of tobacco particles at least partially enclosed by a coating comprising a water-soluble non-crosslinked component and a substantially water-insoluble cross-linked component; or pouches attached to the base tape with a food-grade adhesive, the pouches comprising smokeless tobacco enclosed in a water-permeable wrapper with at least one lap-sealed edge. Methods of preparing such are disclosed.

13 Claims, 1 Drawing Sheet

Related U.S. Application Data continuation of application No. 12/576,960, filed on Oct. 9, 2009, now abandoned.

(51) Int. Cl.

| | |
|---|---|
| ***A24B 13/00*** | (2006.01) |
| ***A24F 23/00*** | (2006.01) |
| ***B65D 83/04*** | (2006.01) |
| ***B65B 13/02*** | (2006.01) |
| ***B65B 29/02*** | (2006.01) |
| ***B65B 61/02*** | (2006.01) |
| ***B65B 61/06*** | (2006.01) |

(52) U.S. Cl.

CPC ..... *B65B 29/02* (2013.01); *B65B 61/02* (2013.01); *B65B 61/06* (2013.01); *B65D 83/0472* (2013.01)

(56) References Cited

U.S. PATENT DOCUMENTS

| | | | |
|---|---|---|---|
| 6,135,120 | A | 10/2000 | Löfman |
| D528,433 | S | 9/2006 | Löfman |
| 2004/0187882 | A1 | 9/2004 | Vink et al. |
| 2006/0118589 | A1 | 6/2006 | Arnarp et al. |
| 2006/0283721 | A1 | 12/2006 | Kutsch et al. |
| 2007/0012328 | A1 | 1/2007 | Winterson et al. |
| 2007/0186941 | A1 | 8/2007 | Holton, Jr. et al. |
| 2007/0261707 | A1 | 11/2007 | Winterson et al. |
| 2008/0029116 | A1 | 2/2008 | Robinson et al. |
| 2008/0156338 | A1 | 7/2008 | Winterson et al. |
| 2008/0173317 | A1 | 7/2008 | Robinson et al. |
| 2008/0202533 | A1 | 8/2008 | Mishra et al. |
| 2008/0202536 | A1 | 8/2008 | Torrence et al. |
| 2008/0308115 | A1 | 12/2008 | Zimmermann |
| 2009/0038631 | A1 | 2/2009 | Mishra et al. |
| 2009/0301505 | A1 | 12/2009 | Liu et al. |

FOREIGN PATENT DOCUMENTS

| | | | |
|---|---|---|---|
| WO | WO03086119 | A1 | 10/2003 |
| WO | WO 2004095959 | A1 | 11/2004 |
| WO | WO 2005115180 | A1 | 12/2005 |
| WO | WO 2008016520 | | 2/2008 |

OTHER PUBLICATIONS

International Preliminary Report on Patentability issued Apr. 11, 2012 in corresponding Application PCT/EP2010/006195.

* cited by examiner

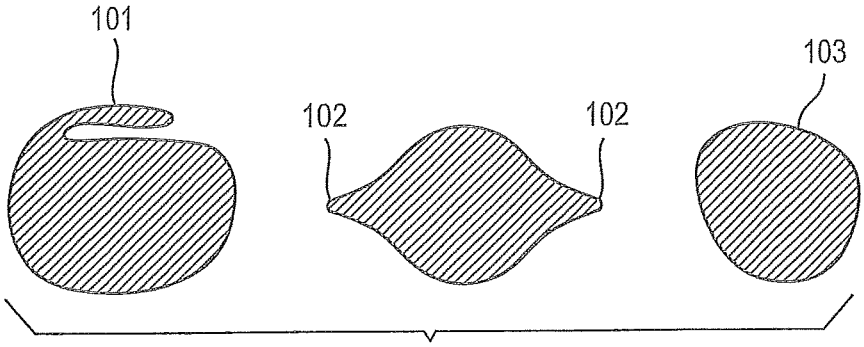
FIG. 1
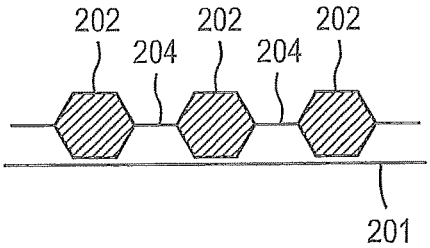
FIG. 2A
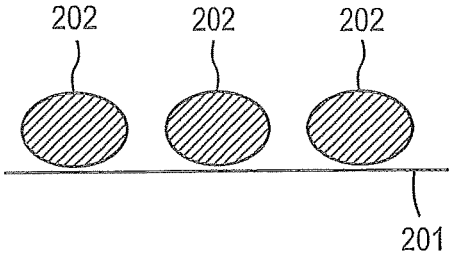
FIG. 2B
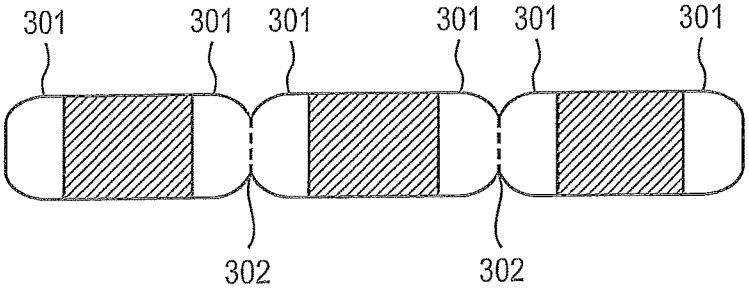
FIG. 3
FIG. 4
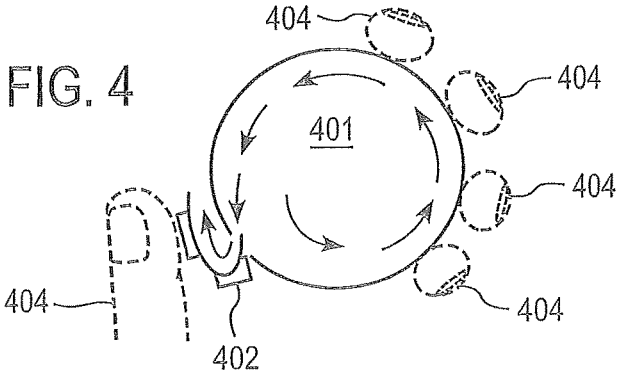

COIL PACKAGING FOR SMOKELESS TOBACCO

CROSS REFERENCE TO RELATED APPLICATION

This application is a divisional application of U.S. application Ser. No. 12/791,658, filed Jun. 1, 2010 entitled COIL PACKAGING FOR SMOKELESS TOBACCO which is a continuation application of U.S. application Ser. No. 12/576,960, filed on Oct. 9, 2009, the entire content of each is herein incorporated by reference.

SUMMARY

A dispenser with a flexible strip of portions of smokeless tobacco comprises a flexible strip comprising a plurality of portions of smokeless tobacco in a serial relationship and each sized to fit in the mouth, and a base tape removably attached to the plurality of portions, and a pocket-sized dispenser housing the flexible strip in a coiled form, wherein the dispenser and flexible strip are adapted to allow a consumer to separate individual portions from the base tape, and wherein the individual portions comprise either: (1) a collection of tobacco particles at least partially enclosed by a coating comprising a water-soluble non-crosslinked component and a substantially water-insoluble cross-linked polymer; or (2) pouches attached to the base tape with a food-grade adhesive, the pouches comprising smokeless tobacco enclosed in a water-permeable wrapper with at least one lap-sealed edge.

In a further embodiment, a method of making a flexible strip of pouches of smokeless tobacco comprises (a) combining portions of tobacco with a water-permeable wrapper; (b) folding the wrapper around the portions to enclose the tobacco; (c) sealing opposing edges of the wrapper with a lap seal to form pouches of smokeless tobacco; and (d) adhering the pouches of smokeless tobacco with a food-grade adhesive to a base tape to obtain a flexible strip of pouches of smokeless tobacco removably attached to the base tape.

In another embodiment, a method of making a flexible strip of portions of smokeless tobacco comprises: (a) forming portions of tobacco particles into units of a pre-portioned tobacco material; (b) contacting the units of pre-portioned tobacco material with a multi-component aqueous coating solution comprising a water-soluble component and a cross-linkable polymer component which forms a substantially water-insoluble polymer upon cross-linking, to form a coating of on the units of pre-portioned tobacco material; (c) cross-linking the cross-linkable polymer in the coating to form portions of smokeless tobacco comprising the units of pre-portioned tobacco material with a semi-dissolvable coating on the surface thereof, the semi-dissolvable coating comprising the water-soluble non-crosslinked component and the substantially water-insoluble cross-linked component; (d) adhering the portions of smokeless tobacco to a base tape to obtain a flexible strip of pouches of smokeless tobacco removably attached to the base tape.

BRIEF DESCRIPTION OF THE DRAWING FIGURES

FIG. 1 illustrates various ways of forming a seam of a pouch of smokeless tobacco sized for oral placement between the cheek and gum.

FIG. 2A illustrates an embodiment of a flexible strip of snus pouches on a base tape wherein the pouches are formed from a unitary wrapper. FIG. 2B illustrates a flexible strip of portions of smokeless tobacco on a base tape.

FIG. 3 illustrates an embodiment of a flexible strip of snus pouches with rounded junctions and perforations.

FIG. 4 illustrates a dispenser with a flexible strip of portions of smokeless tobacco.

DETAILED DESCRIPTION

As used herein, the term "orally enjoyable" denotes the ability of a material or product to be enjoyed and at least partially consumed via the mouth.

As used herein, the terms "particle" or "particles" denote any subdivided form of plant material (such as tobacco), and can include flakes, granules, powders, chopped stems, leaves, flowers, or other pieces, as well as extracts and derivatives thereof.

As used herein, the term "portions of smokeless tobacco" (also called pre-portioned tobacco) denotes pouched tobacco (snus pouches) as well as orally enjoyable tobacco that has been molded or divided into individual servings prior to use, such that the pre-portioned tobacco can be placed in a user's mouth without the need for the user to determine an amount to use. It is intended to include collections of particles that have been pressed or molded or otherwise formed into one or more shapes that are convenient for a user to recognize, manipulate, and/or comfortably insert into the oral cavity and consume, and which contain an amount of tobacco similar to that commonly used by users of moist smokeless products. The term "pre-portioned tobacco material" as used herein refers to the tobacco exclusive of the coating. The term "pre-portioned product" as used herein refers to the coated product as a whole, i.e., to the pre-portioned tobacco material, and its coating.

As used herein, the term "substantially water-insoluble" denotes a material that has a significantly lower solubility in water than the non-cross-linked water-soluble component described herein.

As used herein, the term "smokeless tobacco" denotes orally enjoyable tobacco products, including moist smokeless tobacco ("MST") in orally used pouches (snus pouches).

As used herein, "separably joined," with regard to pouches, refers to snus pouches that are joined to one another, either directly or indirectly, but that can be easily separated from each other by a consumer.

As used herein, the term "about" when used in conjunction with a stated numerical value or range has the meaning reasonably ascribed to it by a person skilled in the art, i.e. denoting somewhat more or somewhat less than the stated value or range, to within a range of ±10% of the stated value.

Smokeless Tobacco

Below are described preferred embodiments of smokeless tobacco used with the flexible strip of tobacco portions described herein.

The starting tobacco for preparing MST is preferably dark fire cured tobacco as typically used for moist snuff in the United States, however other types of tobacco may be used. Suitable types of tobacco include, but are not limited to, flue-cured tobacco, Burley tobacco, Maryland tobacco, Oriental tobacco, rare tobacco, specialty tobacco, reconstituted tobacco, agglomerated tobacco fines, blends thereof and the like. Preferably, the tobacco material is pasteurized. Some or all of the tobacco material may be fermented. As examples of such pre-fermentation steps, a casing material may be applied to the tobacco, the tobacco may be aged, and one or more types of tobacco (e.g., different varieties, having different ages, from different fields, etc.) may be blended to ferment together, or a combination of such steps may be used. Such treatments may optionally be performed following fermentation.

The smokeless tobacco is prepared into the portions products, preferably with a moisture level of 10% or greater by weight, for example, 10 to 60%, e.g., 10, 15, 20, 25, 30, 35, 40, 45, 50, 55, or 60%, as desired.

The tobacco material may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, blends thereof, and the life. Genetically modified tobacco may also be used.

Additionally, the tobacco material may optionally include a supplemental amount of vegetable or plant fibers or particles, such as particles of shreds of lettuce, cotton, flax, beet fiber, cellulosic fibers, blends thereof and the like.

Humectants can also be added to the tobacco material to help maintain the moisture levels in the portioned tobacco product. Examples of humectants that can be used with the tobacco material include glycerol, glycerine, triethylene glycol and propylene glycol. The humectants may also be provided for a preservative effect, as the water activity of the product can be decreased with inclusion of a humectant. In turn, the opportunity for growth of micro-organisms is diminished. Additionally, humectants can be used to provide a higher moisture feel to a drier tobacco component.

Portions of Smokeless Tobacco

As described herein, portions of smokeless tobacco include both pouched tobacco (sometimes called snus pouches) and portions that are preferably free of a fabric and/or paper wrapper and comprise orally enjoyable tobacco that has been molded or divided into individual servings prior to use, such that the pre-portioned tobacco can be placed in a user's mouth without the need for the user to determine an amount to use. Forms of pre-portioned tobacco are described in, for example, commonly-assigned U.S. Patent Publication Nos. 2009/0038631 and 2008/0202533, as well as commonly assigned U.S. patent application Ser. No. 12/367,192 filed on Feb. 6, 2009, each of which is incorporated herein by reference in its entirety.

Preferably, the portion has a generally rectangular or elliptical shape. Other preferred shapes for the pouch include any shape selected from the group consisting of polygons, squares, rectangles, circles, ovals, heart, star, half-moon, crescent, leaf shapes, and combinations thereof.

In a preferred embodiment, the portion is sized and configured to fit inside the mouth, between a user's cheek and gum. Preferably, the pouch takes a generally rectangular shape and is about 20 mm to about 35 mm long, about 10 mm to about 20 mm wide and about 3 mm to about 6 mm thick.

The corners of the portion are preferably rounded. For example, in a strip of pouches, the junction between pouches in preferably rounded, as discussed below.

Pouches

FIG. 1 illustrates exemplary methods of sealing pouches of smokeless tobacco. It is possible to use a fin seal in pouches of smokeless tobacco: a fin seal is either folded over to create undesired bulk of extra layers wrapper (with undesired reduction in permeability) 101, or not folded thereby creating one or more edges 102: in either case, the fin seal contributes to discomfort when the pouch is in the mouth of the user. The pouches as described herein include at least one lap sealed edge 103, which reduces use of wrapper, improves product performance by virtue of improved permeability, and increases comfort to the consumer when the pouch is in the mouth.

A water-permeable wrapper forms a pouch enclosing smokeless tobacco. The wrapper is preferably composed of a fibrous material. The pouch wrapper may be a fabric and/or paper such as filter paper, papers used to construct tea bags, coffee filters, and the like. Preferably, the wrapper is of the type suitable for contact with food, such as materials used for packaging and/or handling foods. The material of the wrapper is porous so that flavors and saliva can travel in and out of the pouch when in use. Preferably, the wrapper is heat sealable.

In an embodiment, the plurality of pouches is formed from a unitary wrapper so that the lap-sealed edge is shared by the plurality of pouches in a strip. The wrapper is optionally divided by perforations, creases, and/or other intentionally-introduced weakness between the individual pouches. Such a unitary wrapper is further described below.

The wrapper may optionally be flavored with a flavorant as described in commonly-assigned U.S. Patent Application Publication No. 2008/0202536, incorporated herein by reference.

The wrapper may optionally include a liner that completely or partially dissolves upon placement of the pouch in the mouth of a consumer, as described in commonly-assigned U.S. Patent Application Publication Nos. 2007/0012328 and 2007/0261707, each of which is incorporated herein by reference.

The wrapper may optionally include a softening agent, which makes the material of the wrapper soft and pliable to provide better comfort to the user upon insertion in the mouth. Suitable softening agents include humectants, oils, and the like. Humectants include, without limitation, glycerin, glycerol, triethylene glycol, and propylene glycol. Oils include any flavored and/or natural oils such as, without limitation, olive oil, sesame oil, peanut oil, coconut oil, corn oil, grapeseed oil, walnut oil, safflower oil, soybean oil, and/or sunflower oil. In addition, oils that have been flavored with herbs may also be used as a softening agent. Preferably, the softening agent is a pleasantly flavored oil that provides an additional layer of flavor to the user and/or acts as the flavorant. The softening agent may be applied to the pouch material by spraying, coating, immersing, embossing, or any other technique.

Often, pouch products turn beige or brown over time due to the enclosed material. Therefore, it is also preferable to treat the wrapper with a browning inhibitor such as that used to prevent fruits from turning brown. Preferred browning inhibitors include, but are not limited to, antioxidants, vitamin E, vitamin C, calcium chloride, sodium hexametaphosphate, sodium bisulfite, and combinations thereof. The browning inhibitor may be applied to the pouch material by spraying, coating, immersing, embossing, or any other technique.

In a preferred embodiment, coloring agents are included in the wrapper. One or more coloring agents may change the color of the pouch to create designs, patterns, a trademark, or to signify pouch flavor (e.g., green to signify mint flavor) The coloring agent may be used to dye the wrapper or coloring agents can be printed onto the wrapper.

In certain embodiments, portions of smokeless tobacco do not require a paper or fabric wrapper. Such forms of pre-portioned tobacco are preferably not pouched, but instead have a membrane coating.

Portions with a Semi-Dissolvable Coating

In an embodiment, a tobacco product has a semi-dissolvable coating, such as a super-hydrated, monolayer membrane, at least partially enclosing a collection of tobacco particles. Such portions preferably do not have a wrapper. The coating is a two-component coating that coats a portion of tobacco material, preferably in a single layer. The two-component coating includes water-soluble, non-crosslinked component and a cross-linked polymer component. The cross-linked polymer is substantially water-insoluble. Optionally, the substantially water-soluble component is a polymer and/or is non-cross-linkable. The tobacco material is preferably a molded portion of moist snuff tobacco.

By controlling the relative amounts of the water-soluble, non-crosslinked component and the cross-linked polymer, the portion can be adapted either to break apart in the user's mouth or to remain intact in the user's mouth. In the latter case, after the soluble component dissolves in a user's mouth, the coating creates a porous network composted of a substantially insoluble polymer.

Accordingly, in an embodiment, the soluble component dissolves rapidly in a user's mouth such that the substantially insoluble cross-linked polymer component remains intact throughout use of the tobacco product, so that the coating allows the tobacco juices and flavors to leach out of the coating, while still remaining intact to hold the tobacco within the coating through the duration of tobacco use while providing a soft compliant feel to the tongue and mouth tissues. Because in this embodiment the coating acts to contain the tobacco while it is in the user's mouth, when the user desires to remove the portion from the mouth, this can be easily accomplished.

In another embodiment, the tobacco material is completely disintegrable so that once the soluble component of the coating dissolves and tobacco material has disintegrated, a user may chew and either spit out or ingest the remaining insoluble component. The coating desirably contains a minority amount of the substantially water-insoluble, cross-linked polymer, which minority amount is insufficient for the pre-portion to retain its structural integrity in the user's mouth after the water-soluble, non-cross-linked component has dissolved. Thus, the particles of tobacco contained within the coating are released and/or dispersed in the user's mouth once the water-soluble component dissolves and the pre-portioned form disintegrates.

Such portions can be prepared by forming portions of tobacco particles into units of a pre-portioned tobacco material; contacting the units of pre-portioned tobacco material with a multi-component aqueous coating solution comprising a water-soluble, non-crosslinked component and a cross-linkable polymer which forms a substantially water-insoluble polymer upon cross-linking, to form a coatings on the units of pre-portioned tobacco material; cross-linking the cross-linkable polymer to form portions of smokeless tobacco comprising the units of pre-portioned tobacco material with a semi-dissolvable coating on the surface thereof. The portions of smokeless tobacco can be adhered to a base tape to obtain a flexible strip of portions of smokeless tobacco removably attached to the base tape.

In a preferred embodiment, a coating is prepared from a multi-component polymer solution (coating solution). The pre-portioned amount of moist tobacco can be enclosed by the coating by applying to at least some of the outer surface of the portion a polymer solution including at least two components. At least one component of the coating solution is a water-soluble, non-cross-linkable component, which dissolves in the mouth. At least one other component in the coating solution is a water-soluble, cross-linkable polymer which becomes substantially water-insoluble after crosslinking. The coating may be applied to the moist pre-portioned tobacco by a variety of techniques, which can include dipping, spraying, and the like. The coated pre-portioned tobacco is then contacted with a cross-linking agent suitable for the cross-linkable polymer or polymers employed in the coating. This contact can result from application of the cross-linking agent to the coated portion, e.g., by spraying, dipping, or other application of a solution of cross-linking agent to the coated portion (resulting in an "outside-in" direction of cross-linking). Alternatively, cross-linking can result from contact of the cross-linkable polymer with cross-linking agent already present in the tobacco, either as the result of cross-linking agent present in the tobacco before it is formed into a pre-portion, or as the result of the application of cross-linking agent to the pre-portion prior to application of the coating.

The coating is preferably in the form of a gel, more particularly in the form of a hydrogel. As a result, a significant portion of the weight of the coating is water, in addition to the water-soluble non-crosslinked component and the substantially water-insoluble cross-linked polymer, as well as cross-linking agents, and any additives, such as preservatives, flavorants, etc. Because only the water-soluble, non-cross-linked component of the coating dissolves and releases moisture into the user's mouth, the amount of moisture released is controlled, and is not excessive. This provides the user with decreased slipperiness and improved mouthfeel when using the product.

Preferably, the water-soluble, non-cross-linked component dissolves rapidly in a user's mouth. In a preferred embodiment, the soluble component dissolves in about 0.1 seconds to about 10 seconds (e.g., about 1 second to about 9 seconds, about 2 seconds to about 8 seconds, about 3 seconds to about 7 seconds or about 4 seconds to about 6 seconds) after introduction into the oral cavity. Also preferably, the pre-portioned form loses its structural integrity within about 5 to about 15 seconds (e.g., about 6 to about 14 seconds, about 7 to about 13 seconds, about 6 to about 12 seconds, about 7 to about 11 seconds or about 8 to about 10 seconds) after introduction into the oral cavity.

The water-soluble component and substantially water-insoluble component may be natural or synthetic. Preferably the components are hydrocolloids. More preferably, the components are polysaccharides.

Optionally, the water-soluble component comprises a non-cross-linked and/or non-crosslinkable polymer. In an embodiment, the water-soluble component can be formed by a cross-linkable polymer, which has not reacted with a cross-linking agent. Suitable water-soluble non-crosslinked components include, without limitation, starch and starch derivatives, such as modified starch, dextrin, gums, such as gum arabic, guar gum, xanthan gum, locust bean gum, curdlan gum, gellan gum, fenugreek derivative gums, pullulan, chitosan, chitin, cellulose and cellulose derivatives, synthetic polymers, such as polyvinyl alcohol, polylactide, polyethylene glycol, polyvinylpyrrolidone, or polyvinylacetate, and soluble or insoluble vegetable fiber.

Suitable chemically cross-linkable polymers include, without limitation, alginate, pectin, carrageenan, and modified polysaccharides with cross-linkable functional groups. Preferred cross-linkable polymers are pectins and alginates. Proteins, for example gelatin, zein, soy protein, rice protein, and whey protein, can optionally be used to supplement or replace the cross-linkable polymers that are cross-linked with monovalent and bivalent metal ion salts. The proteins slowly cross-link with phenolics and/or aldehydes that occur naturally in tobacco.

In a preferred embodiment, the cross-linking agent is a polyvalent metal salt, more particularly, a monovalent metal ion salt or bivalent metal ion salt. While, both monovalent and bivalent metal ion salts may be used, a bivalent metal ion salt is particularly suitable for crosslinking certain polysaccharides, such as pectins. Suitable cross-linking agents include, without limitation, calcium lactate, calcium chloride, calcium lactobionate, tricalcium phosphate, calcium glycerophosphate, calcium hexametaphosphate, calcium acetate, calcium carbonate, calcium bicarbonate, calcium citrate, calcium gluconate, sodium chloride, sodium lactate, sodium acetate, sodium carbonate, sodium bicarbonate, sodium citrate, sodium gluconate, potassium chloride, potassium lactate, potassium acetate, potassium carbonate, potassium bicarbonate, potassium citrate, potassium gluconate and combinations of these.

Preferably, the pre-portioned product weighs about 1.0 to 3.0 grams, and more preferably about 2.0 to about 2.5 grams. The weight is predominately based on the amount of tobacco used since the weight of the coating is small as compared to that of the tobacco. In an embodiment, the pre-portioned product may be up to about 1.5 inches long, up to 1 inch in height, and up to ¾ inch in width. Preferably, the pre-portioned product is flexible, compressible, and capable of conforming to the shape of the oral cavity.

Suitable flavor additives and aromas for inclusion in the coating or the tobacco material include, but are not limited to, any natural or synthetic flavor or aroma, such as tobacco, smoke, menthol, peppermint, spearmint, bourbon, scotch, whiskey, cognac, *hydrangea*, lavender, chocolate, licorice, citrus and other fruit flavors, such as apple, peach, pear, cherry, plum, orange and grapefruit, gamma octalactone, vanillin, ethyl vanillin, breath freshener flavors, spice flavors such as cinnamon, clove, nutmeg, sage, anise, and fennel, methyl salicylate, linalool, jasmine, coffee, bergamot oil, geranium oil, lemon oil, and ginger oil. Other suitable flavors and aromas may include flavor compounds selected from the group consisting of an acid, an alcohol, an ester, and aldehyde, a ketone, a pyrazine, combinations or blends thereof and the like. Suitable flavor compounds may be selected, for example, from the group consisting of phenylacetic acid, solanone, megastimatrienone, 2-heptanone, benzylalcohol, cis-3-hexenyl acetate, valeric acid, valeric aldehyde, ester, terpene, sequiterpene, nootkatone, maltol, damascenone, pyrazine, lactone, anethole, isovaleric acid, combinations thereof and the like.

The coating may also include additives such as natural or artificial sweeteners. Preferred sweeteners include, without limitation, water soluble sweeteners, such as monosaccharides, disaccharides, and polysaccharides, such as xylose, ribose, sucrose, maltose, fructose, glucose, and mannose.

Additives such as chemesthesis agents may also be included in the coating. Suitable chemesthesis agents for inclusion in the coating include, without limitation, capsaicin, tannins, mustard oil, wintergreen oil, cinnamon oil, allicin, quinine, citric acid, and salt.

In one embodiment, the coating is created via ionic cross-linking. One or more polymers are used to create a single layer, thin coating over a portion of a tobacco material.

1. Easy-in, Loose-Out Portions

The follows relates primarily to portions that break apart in the mouth (this trait sometimes described as "easy-in, loose-out"), however aspects may apply to other types of portions.

Preferably, when preparing portions that break apart in the mouth (such a trait sometimes being termed "easy-in, loose-out"), the water-soluble non-crosslinked component is included in an amount of about 15% to about 30% by weight based on the weight of the coating solution, and the cross-linkable polymer which forms a substantially water-insoluble polymer upon cross-linking is included in an amount of about 0.3% to about 1.5% by weight based on the weight of the coating solution. Once placed in the mouth, the soluble, non-cross-linked component dissolves. The substantially insoluble, cross-linked component is insufficient to hold the particles of tobacco together, so that the tobacco is released and/or dispersed in loose form in a user's mouth. The result is a pre-portioned moist tobacco product which has sufficient structural integrity to be handled and inserted into the mouth by the user, but which breaks up after insertion in the user's mouth, to replicate the experience of using loose moist smokeless tobacco.

If less than about 15% water-soluble component is used in the coating solution, the pre-portioned product will undesirably tend to break up into large chunks upon dissolution of the water-soluble, non-cross-linked polymer. If more than about 30% of the coating solution is the water-soluble non-cross-linked polymer, the pre-portioned product will have insufficient structural integrity to allow a user to handle it while placing it in the mouth.

Preferably, the substantially water-insoluble component is formed by reacting a chemically cross-linkable polymer with a cross-linking agent. Preferably, the coating solution includes the substantially water-insoluble component in an amount of about 0.3% to about 1.5% by weight based on the weight of the coating solution. If less than about 0.3% substantially water-insoluble component is used in the coating solution, the pre-portioned product will be too weak for a user to handle when placing in the mouth, and will break apart. If a coating contains more than about 1.5% substantially water insoluble component, the coating will provide greater structural integrity to the product, so that it will tend not to break apart and disperse the tobacco material in the user's mouth.

The amount of cross-linking agent used will depend to a large extent on the amount of cross-linkable polymer included in the coating mixture. For the preferred amounts of cross-linkable polymers disclosed herein, preferably, the cross-linking agent is included in a cross-linking solution of about 0.5 wt % to about 2.0 wt %, based on the total weight of the cross-linking solution, more preferably about 0.5 wt % to about 1.5 wt %. Using less than 0.5 wt % cross-linking agent will generally not provide enough cross-linking agent to react with the amounts of cross-linkable polymer included in the coating mixture, which tends to result in a weak coating that will not provide the pre-portioned product with sufficient structural integrity for user handling when retrieving the product and positioning it in the oral cavity. Using more than about 2.0 wt % is unnecessary due to the low amount of cross-linkable polymer present, thereby adding unnecessary cost to the product, and may adversely affect the flavor of the product.

Once the water-soluble component of the coating dissolves, flavors and water are released into the user's mouth and the pre-portioned product loses its structural integrity so that the tobacco enclosed by the coating is released. The pre-portioned product thus provides both rapid flavor release and a replication of the experience of using loose moist smokeless tobacco very soon after insertion into the user's oral cavity.

In addition, due to the presence of relatively small amounts of water-soluble component, excess water and juice are not released upon disintegration of the pre-portioned product. The combination of polymers in the coating, in the ranges disclosed herein, provides a soft compliant feel to the tongue and mouth tissues, and dissolves quickly, so that the sensory experience associated with moist tobacco use is rapid and unencumbered. In addition, because only small quantities of the substantially water-insoluble cross-linked polymer remain on a small quantity of the tobacco (i.e., only that quantity of tobacco that was actually in contact with the coating) after the pre-portioned product has disintegrated in the user's mouth, the tobacco that disperses is essentially uncoated. The resulting sensory experience replicates more closely what users expect from moist smokeless tobacco than would a product where the individual particles have been coated.

In a preferred embodiment, the coating is not messy or sticky to the touch. With the at least two polymers are used to create the coating, when a user touches the coating, the polymers do not disassociate from one another. Therefore, the coating is not sticky when the product is removed from a package and placed in the mouth.

Example 1

To form a coating, a round bottom flask is charged with 1% pectin, 1% dextrin, 0.04% alginate, and balance deionized water. The mixture is stirred and heated to about 50° C. to 100° C. to dissolve the polymers and form a coating solution. The coating solution is cooled down to room temperature and then transferred to a plastic pan. 2.5 g of moist tobacco is first molded into a tetragonal shape and then dipped into the above-described solution. A cross-linking solution of 0.5% calcium lactate in water is prepared. The coating on the moist tobacco is then cross-linked with the cross-linking solution by dipping the molded coated tobacco into the cross-linking solution. The sample is exposed in air to evaporate moisture until the weight of the coated moist tobacco product reaches about 2.5 g to 2.8 g.

Example 2

The procedure described above in Example 1 is repeated, except that no calcium lactate solution is applied to the coated moist tobacco portion.

Example 3

To form a coating, a round bottom flask is charged with 0.38 wt % pectin, 23 wt % dextrin and balance deionized water. The mixture is stirred and heated to about 50° C. to 100° C. to dissolve the polymers. The coating solution is cooled down to room temperature and then transferred to a plastic pan. 2.5 g of moist tobacco is first molded into a tetragonal shape and then dipped into the above-described solution. A cross-linking solution of 0.5 wt % calcium lactate in water is prepared. The coating on the moist tobacco is then cross-linked with the cross-linking solution by dipping the molded tobacco into the cross-linking solution. The sample is exposed in air to evaporate moisture until the weight of the coated moist tobacco product reaches about 2.5 g to 2.8 g.

Example 4

To form a coating, a round bottom flask is charged with 0.38 wt % pectin, 23 wt % dextrin, 0.014 wt % wintergreen flavorant, 0.98 wt % polysorbate 20 and balance deionized water. The mixture is stirred and heated to about 50° C. to 100° C. to dissolve the polymers and form a coating solution. The coating solution is cooled down to room temperature and then transferred to a plastic pan. 2.5 g of moist tobacco is first molded into a tetragonal shape and then dipped into the above-described solution. A cross-linking solution of 0.5 wt % calcium lactate in water is prepared. The coating on the moist tobacco is then cross-linked with the cross-linking solution by dipping the molded tobacco into the cross-linking solution. The sample is exposed in air to evaporate moisture until the weight of the coated moist tobacco product reaches about 2.5 g to 2.8 g.

Example 5

To form a coating, a round bottom flask is charged with 0.38 wt % pectin, 23 wt % dextrin, 0.014 wt % wintergreen flavorant, 0.98 wt % polysorbate 20, 0.1 wt % methyl paraben and balance deionized water. The mixture is stirred and heated to about 50° C. to 100° C. to dissolve the polymers and form a coating solution. The coating solution is cooled down to room temperature and then transferred to a plastic pan. 2.5 g of moist tobacco is first molded into a tetragonal shape and then dipped into the above-described solution. A cross-linking solution of 0.5 wt % calcium lactate in water is prepared. The coating on the moist tobacco is then cross-linked with the cross-linking solution by dipping the molded tobacco into the cross-linking solution. The sample is exposed in air to evaporate moisture until the weight of the coated moist tobacco product reaches about 2.5 g to 2.8 g.

Example 6

The procedure described above for Example 3 is repeated, except that the coating solution is sprayed onto the molded moist tobacco portion, instead of dipping the portion in the coating solution.

Example 7

The procedure described above for Example 3 is repeated, except that a coating solution of 15 wt % modified starch (National Starch) and 1 wt % pectin is used, and no cross-linking solution is used.

Example 8

The procedure described above for Example 7 is repeated, except that a coating solution of 20 wt % modified starch and 1 wt % pectin is used.

Example 9

The procedure described above for Example 8 is repeated, except that the coated portion was further coated with a coating solution of 0.38 wt % pectin and 23 wt % dextrin after coating with the modified starch solution.

Example 10

The procedure described above for Example 3 is repeated, except that no cross-linking solution is used.

2. Easy-in, Easy-Out Portions

The follows relates primarily to portions adapted to remain intact in the mouth of a user (a trait sometimes described as "easy-in, easy-out"), however aspects may apply to other types of portions.

In a preferred embodiment, a multi-component polymer coating containing at least two polymers is used so that the properties of the coating, such as the rate of dissolution and the size and amount of pores in the coating, can be controlled. Such a coating comprising two polymers is sometimes referred to as a "super-hydrated membrane coating."

Preferably, the coating is aesthetically pleasing, non-tacky, and pleasant to touch, while being strong enough to maintain the integrity of the portion of moist tobacco material contained inside the coating during insertion and placement in the mouth. The coating is preferably clear, but fillers may be added to provide the coating with a desired color or appearance.

The coating described below has advantages over other coatings. These advantages are described in commonly-owned U.S. Patent Publication No. 2008/0202533.

The super-hydrated membrane coating preferably creates a porous network of an insoluble polymer after the soluble component dissolves in a user's mouth. Preferably, the first component is a soluble component that dissolves rapidly in a user's mouth such that the second component, which is preferably the insoluble component, remains intact throughout use of the tobacco product.

Preferably, the soluble component is formed by a non-cross-linkable polymer. As used herein, the term "non-cross-linkable" denotes that the material does not become cross-linked to a significant extent when subjected to conditions that cross-link the insoluble component. Also preferably, the insoluble component is formed by a chemically, cross-linkable polymer reacted with a cross-linking agent. The polymers of the soluble component and insoluble component may be natural or synthetic. Preferably the polymers are hydrocolloids. More preferably, the polymers are polysaccharides.

In a preferred embodiment, the cross-linking agent is a monovalent metal ion salt or bivalent metal ion salt.

Suitable non-chemically-cross-linkable polymers include, without limitation, starch, dextrin, gum arabic, guar gum, chitosan, cellulose, polyvinyl alcohol, polylactide, gelatin, soy protein, and whey protein.

Suitable chemically, cross-linkable polymers include, without limitation, alginate, pectin, carrageenan, and modified polysaccharides with crosslinkable functional groups. The preferred cross-linkable polymer is alginate.

While, both monovalent and bivalent metal ion salts may be used, preferably a bivalent metal ion salt is used. Suitable bivalent metal ion salts include, without limitation, calcium lactate and calcium chloride. Calcium lactate is preferred since it is approved for use in food products.

Once the soluble component of the coating dissolves, pores are created in a polymer network through which the tobacco juices and flavors flow. Flavors and water are released into the user's mouth as the soluble component of the coating dissolves. The tobacco flavors and juices are then released through the pores so that the flavor experience is seamless from beginning to end. In a preferred embodiment, the bulk density of the coated tobacco product is about $1.0 \pm 0.2$ g/cm$^3$.

Preferably, the pores, created when the soluble component of the coating dissolves, are large enough to allow the unencumbered flow of juices, while remaining small enough to prevent shreds or particles of tobacco from traveling through the pores and into the user's mouth.

The coating preferably encloses a pre-portioned tobacco material. Also, the coating allows the tobacco juices and flavors to leach out of the coating, while still remaining intact to hold the tobacco within the coating through the duration of tobacco use. The coating provides a soft compliant feel to the tongue and mouth tissues.

Because the soluble component of the coating dissolves quickly, the sensory experience associated with moist tobacco use is rapid and unencumbered.

Once the soluble component of the super-hydrated membrane coating dissolves or disintegrates, additional moisture and/or flavors are released into the user's mouth. Thereafter, the flavors and tobacco juices pass through the coating to provide an uninterrupted flavor experience to the user.

In a preferred embodiment, the super-hydrated membrane coating may be provided with a desired rate of dissolution of the soluble component of the coating by altering the proportion of the soluble component to the insoluble component.

In a preferred embodiment, the super-hydrated membrane coating is not messy or sticky to the touch. Because at least two polymers are used to create the coating, when a user touches the coating, the polymers do not disassociate from one another. Therefore, the coating is not sticky when the product is removed from a package and placed in the mouth.

The tobacco material may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, blends thereof, and the life. Genetically modified tobacco may also be used.

Additionally, the tobacco material may also include a supplemental amount of vegetable or plant fibers or particles, such as particles of shreds of lettuce, cotton, flax, beet fiber, cellulosic fibers, blends thereof and the like.

In one embodiment, the super-hydrated membrane coating is created via ionic cross-linking. One or more polymers are used to create a single layer, thin membrane coating over a portion of a tobacco material.

In a preferred embodiment, a multi-component polymer coating containing at least two polymers is used so that the properties of the super-hydrated membrane coating, such as the rate of dissolution and the size and amount of pores in the coating, can be controlled.

The size of the pores, created when the soluble component dissolves, may be altered by patterning the coating in such a way as to ensure the soluble component is only in certain spots and in certain amounts so that once the soluble component dissolves away the pores are of a desired size.

In an embodiment, tobacco material is dipped in a polymer solution containing two different polymers dissolved in water. Preferably, a chemically cross-linkable polymer and a non-cross-linkable polymer are used.

Because moist tobacco naturally contains salts such as calcium ions, the calcium ions preferably cross-link with the cross-linkable polymer to form a skin or shell on the inside of the coating once the tobacco material has been contacted with the two polymer solution. Later, when the coating is exposed to a cross-linking agent, an outer skin or shell can form on the coating. The inner and outer skins or shells provide a moisture barrier for the tobacco and the soluble portion of the coating. Preferably, the shells/skins are formed of a discontinuous, cross-linkable polymer with regions of the non-cross-linkable polymer incorporated therein.

In a preferred embodiment, the concentration of the film forming polymer solution is about 0.5 wt % to 20 wt % polymer in the solution. Most preferably, the concentration of the film forming polymer solution 30 is about 1 wt % to 1.5 wt % of the polymer components with the balance being water.

The concentration of the polymer solution determines the thickness of the coating membrane. The thickness of the coating can in turn affect how quickly the soluble component of the coating dissolves in a user's mouth. The coating is a moist, gel-like coating when formed and the moistness is preferably retained until use. Preferably, the coated tobacco product is hermetically sealed in suitable packaging to prevent moisture in the tobacco and coating from evaporating.

If the coating is peeled off of the tobacco product and completely dried, the coating is preferably about 0.02 mm to 1.0 mm thick. More preferably, when the coating is completely dried, it is about 0.08 mm to 0.14 mm thick. In a most preferred embodiment, the coating when completely dried is about 0.11 mm thick. It should be noted that the coating is not intended to be dried, but rather retains a high moisture content.

In a preferred embodiment, the weight of the coating when completely dried is about 0.013 g for a coated tobacco product weighing about 2.5 g. In contrast, the weight of the coating for a coated tobacco product weighing about 2.5 g, when the coating is at the preferred moisture content is about 0.15 g.

After coating the tobacco material with the film forming polymer solution, cross-linking is conducted with a cross-linking solution including a monovalent metal ion salt or a bivalent metal ion salt.

Preferably, the cross-linking solution contains a bivalent metal ion salt. Most preferably, the cross-linking solution includes calcium lactate, which is commonly used in the food industry. In one embodiment, the cross-linking solution is a 2.0 wt % calcium lactate solution.

The tobacco product is then exposed to air or patted dry to evaporate excess moisture. The tobacco product is not dried extensively, so that the super-hydrated coating retains a high moisture content.

By using both a non-cross-linkable polymer and a cross-linkable polymer, the porosity and strength of the super-hydrated membrane coating can be controlled. For instance, the dissolution rate of the resulting super-hydrated membrane coating can be altered by modifying the specific proportion of cross-linked to non-cross-linked polymers. In a preferred embodiment, the coating contains 10 to 90 wt % of the cross-linked polymer. Preferably, the proportion of cross-linked polymer in the coating is 60 to 70 wt %.

In another embodiment, the polymer solution and the cross-linking solution can be patterned, overprinted, or sprayed onto the tobacco material preform to form a network having a soluble component and an insoluble component. The polymer solution may include a chemically, cross-linkable polymer and a non-cross-linkable polymer. Alternatively, the polymer solution may include a single chemically, cross-linkable polymer. When a single polymer is used, the cross-linking solution may be selectively sprayed to leave some portions of the coating non-cross-linked and soluble. The soluble component of the coating may dissolve, leaving a porous network of insoluble component in place to maintain coherence of the tobacco material, while allowing the free flow of saliva in the user's mouth.

In an embodiment, the process may be automated. For instance, the coating step may occur via spraying the polymer solution and the cross-linking solution alternately onto a preformed portion of tobacco material to create a cross-linked, thin, super-hydrated membrane coating of a desired thickness.

In an embodiment, tobacco-based polymers may be substituted for non-tobacco sourced materials in the coating. Flavorful tobacco compounds may be extracted from the tobacco based material in order to modify the tobacco flavor character to initial in-mouth experience. However, such high extraction is unnecessary.

In one embodiment, additional dissolvable tobacco such as tobacco extracts or colloidal encapsulated tobacco can be added to the coating to increase the initial tobacco flavor in the first stages of the dissolution of the super-hydrated membrane coating.

Fillers may be added to the coating to make the coating opaque. Colorants may also be added to alter the color of the coating.

The following examples are exemplary and are not meant to limit any aspects of the embodiments disclosed herein.

Example 11

To form a super-hydrated membrane coating by ionic cross-linking of two biopolymers, a round bottom flask was charged with 1.0 g alginate, 0.5 g starch and 98.5 ml of deionized water. The mixture was stirred and heated to about 50° C. to 100° C. to dissolve the biopolymers The solution was cooled down to room temperature and then transferred to a plastic pan. 2.5 g of moist tobacco was first molded into a rectangular shape and then dipped into the above described solution. A cross-linking solution of 2.0 wt % calcium lactate in water was prepared. The coating on the moist tobacco was then cross-linked with the 2.0 wt % cross-linking solution. The sample was exposed in air to evaporate moisture until the weight of the coated moist tobacco product reached about 2.5 g to 2.8 g.

Example 12

To form a super-hydrated membrane coating by ionic cross-linking of two biopolymers, a round bottom flask was charged with 1.0 g alginate, 0.5 g gum arabic and 98.5 ml of deionized water. The mixture was stirred and heated to about 50° C. to 100° C. to dissolve the biopolymers. The solution was cooled down to room temperature and then transferred to a plastic pan. A cross-linking solution of 2.0 wt % calcium lactate in water was created. 2.5 g of moist tobacco was first molded into a rectangular shape and then dipped into the above described solution. The coating on the moist tobacco was then cross-linked with the 2.0 wt % cross-linking solution. The sample was exposed in air to evaporate moisture until the weight of the coated moist tobacco product reached about 2.5 g to 2.8 g.

Example 13

To form a super-hydrated membrane coating by ionic cross-linking of two biopolymers, a round bottom flask was charged with 1.0 g alginate, 0.5 g soy protein and 98.5 ml of deionized water. The mixture was stirred and heated to about 50° C. to 100° C. to dissolve the biopolymers. The solution was cooled down to room temperature and then transferred to a plastic pan. A cross-linking solution of 2.0 wt % calcium lactate was prepared. 2.5 g of moist tobacco was first molded into a rectangular shape and then dipped into the above described biopolymer solution. The coating on the moist tobacco was then cross-linked with the 2.0 wt % cross-linking solution. The sample was exposed in air to evaporate moisture until the weight of the coated moist tobacco product reached about 2.5 g to 2.8 g.

Flexible Strip of Pre-Portioned Tobacco

A flexible strip includes a plurality of portions of smokeless tobacco in a serial relationship, and a base tape removably attached (optionally with a food-grade adhesive) to the plurality of portions. In an embodiment, the portions are held together in the serial relationship by a base tape, and, if the portions are pouches, the pouches are individually wrapped. Alternately to the pouches being individually wrapped, the flexible strip may comprise separably joined pouches sharing a unitary wrapper. In either case, individual pouches may be detached from the base tape.

Preferably, the individual portions are suitable for placement in the mouth immediately upon being detached from the from the base tape. For example, in a preferred embodiment, no additional wrapping needs to be removed before the detached portions are orally enjoyable (for example, preferably there is no secondary wrapper, such as on one or more sides of the pouch not in contact with the base tape, not intended for placement in the mouth).

Portions may be removed from the base tape by hand or by using the lips and/or teeth.

FIG. 2 illustrates embodiments with a base tape 201 removably attached to the portions 202. Individual portions 202 are preferably removed from the base tape 201 prior to oral enjoyment of the portions 202. The base tape 201 (which is preferably not orally enjoyable) helps support the flexible strip and smoothes the dispensing from the dispenser, by providing a relatively smooth surface that is optionally more rigid than the material of the wrapper. The base tape may be attached to the portions with a food-grade adhesive so that individual portions can easily be detached from the base tape. In the case of portions having a semi-dissolvable coating, the coating may optionally be used to attach the portions to the base tape (for example, the portions may be dried on the base tape), and/or adhesive could be used.

When the portions are pouches, the pouches of the flexible strip may have a unitary wrapper as discussed herein and illustrated in FIG. 2A. FIG. 2A also depicts the location of an optional perforation 204 in a section of unitary wrapper between pouches.

As illustrated in FIG. 2B, the portions may be discrete, and, in the case of pouches, the pouches may be individually wrapped pouches (lacking a unitary wrapper shared by the pouches). The base tape facilitates the presentation of individual portions in the form of a flexible strip comprising a plurality of portions of smokeless tobacco in a serial relationship (FIG. 2B). As used herein, "individually wrapped" refers a pouches in a flexible strip of pouches wherein the individual pouches are not connected by their wrapper, but instead kept together by the base tape.

The flexible strip of portions with attached base tape, and optional dispenser (details of which are provided below) are preferably adapted so that a consumer may easily remove individual portions from the base tape. Preferably, the portions are suitable for oral enjoyment immediately upon removal from the base tape, and are preferably free of any secondary wrapper not intended for placement in the mouth. Also preferably, the base tape remains intact upon removal of individual portions (the excess tape may optionally be reinserted into the dispenser housing the flexible strip, discussed below). Optionally, the base tape may be torn off by a consumer, for example at any position desired, or at one or more positions defined by, e.g., perforations in the base tape (which may or may not correspond in position to optional perforations in a wrapper).

The base tape preferably includes a visual indicator adapted to depict a quantity of portions remaining in the dispenser. Thus, a consumer advantageously may be alerted as to how many portions are left before the end of the flexible strip, even if the dispenser is opaque. The visual indicator may comprise a line on the tape that extends diagonally from one corner to the other, so that the position of the line denotes the quantity remaining. An indicator line may be stepped, comprising short segments that are generally parallel to the tape but that shift from one side to the other along the length of the tape, where preferably each such segment corresponds to once pouch. The base tape may have a color as a visual indictor. For example, green may indicate that the dispenser has many portions remaining, yellow that few portions remain, and red that very few portions remain. The visual indicator may also be any sort of pattern or printing on the base tape, for example a numeral to indicate the number of portions remaining before the end of the flexible strip. Preferably, the visual indicator spans the entire length of the tape, however optionally the visual indicator may exist only near the end of the tape, for example at the final 30%, 20%, 10% of the tape. The visual indicator may include any combination of the above features.

In a preferred embodiment, pouches are wrapped with a unitary wrapper, namely a one-piece wrapper shared by all of the pouches, so that the lap-sealed edge is shared by all of the pouches. Preferably, the lap-sealed edge is parallel to the length of the flexible strip. The pouches may optionally be separated from each other by a perforated connection or junction between adjacent portions.

Preferably, in sections of a unitary wrapper between adjacent pouches have rounded junctions between the individual pouches, the pouches having rounded corners. Accordingly, when separated, the rounded corners of the individual pouches reduce irritation in the mouth of a consumer as compared to conventional angled corners. In FIG. 3 illustrating an embodiment with a unitary wrapper, lines 301 denote seams between individual pouches in the flexible strip, while dashed lines 302 are perforations at junctions between the pouches, where the junctions are rounded so that, upon detaching, the individual pouches have rounded corners. A lap-sealed edge (not shown) is shared by the pouches. In the embodiment of FIG. 3, the lap-sealed edge runs horizontally along the flexible strip, with preferably a folded edge opposite the lap-sealed edge, also running horizontally along the flexible strip.

A method of making the flexible strip of pouches of smokeless tobacco includes combining portions of smokeless tobacco with a water-permeable wrapper; folding the wrapper around the portions to enclose the smokeless tobacco; sealing opposing edges of the wrapper with a lap seal to form pouches of smokeless tobacco; and adhering the pouches of smokeless tobacco with a food-grade adhesive to a base tape to obtain a flexible strip of pouches of smokeless tobacco removably attached to the base tape.

In the case of a unitary wrapper, the sealing forms a flexible strip of pouches of smokeless tobacco separably joined in a serial relationship and sharing a unitary wrapping and wherein the lap-sealed edge is shared by individual pouches separably joined in a serial relationship.

In the case of individually wrapped pouches, the method includes cutting the wrapper to produce the individually-wrapped pouches.

In an embodiment comprising portions with a semi-dissolvable coating, a method of making a flexible strip of portions of smokeless tobacco comprises: (a) forming portions of tobacco particles into units of a pre-portioned tobacco material; (b) contacting the units of pre-portioned tobacco material with a multi-component aqueous coating solution comprising a water-soluble, non-cross-linkable polymer and a cross-linkable polymer which forms a substantially water-insoluble polymer upon cross-linking, to form a coatings on the units of pre-portioned tobacco material; (c) cross-linking the cross-linkable polymer to form portions of smokeless tobacco comprising the units of pre-portioned tobacco material with a semi-dissolvable coating on the surface thereof; (d) adhering the portions of smokeless tobacco to a base tape to obtain a flexible strip of portions of smokeless tobacco removably attached to the base tape.

Dispenser of the Flexible Strip

The flexible strip may preferably be provided with a pocket-sized dispenser. Such a dispenser preferably acts as a package to contain the flexible strip. The flexible strip is preferably coiled within the dispenser.

The dispenser may be adapted to be held with one hand while advancing the flexible strip through the dispenser with the same hand, for example with the thumb of the same hand, with an embodiment illustrated in FIG. 4, showing dispenser 401 and flexible strip of portions of smokeless tobacco 402. Arrows depict the movement of the flexible strip as it is advanced through the dispenser by thumb 404 while the dispenser is gripped with fingers 404. Preferably, portions may detached from the base tape with one hand while holding the dispenser with the other hand, or alternatively detached by using the lips and/or teeth.

The dispenser may comprise two or three pieces. For example, the dispenser may comprise two sides joined together, and optionally include a third piece such as a spiral form to hold the flexible strip. Optionally, the flexible strip is loose within the dispenser.

The dispenser preferably includes a removable cover of an opening via which the flexible strip is dispensed, wherein the cover is optionally replaceable over the opening following dispensing. Such a cover can act to maintain freshness of the tobacco.

In embodiments including a base tape, the dispenser optionally is adapted to receive excess or waste base tape (e.g., base tape from which one or more portions have been removed). Excess or waste base tape may be reinserted into the same opening in the dispenser from which the flexible strip with base tape is dispensed, or optionally the dispenser may include a second opening adapted to receive the excess or waste base tape.

Preferably, the dispenser may be made of paperboard and/or plastic, however other suitable materials can be used. Preferably, all sides of the dispenser are available for display of printed messages.

The dispenser optionally includes a portion adapted to aid a consumer in removing a portion from the base tape, for example a protrusion of the dispenser adapted to assist in removing a portion by shearing when a shear force is applied by a consumer (e.g., with a thumb or finger).

All of the above-mentioned references are herein incorporated by reference in their entirety to the same extent as if each individual reference was specifically and individually indicated to be incorporated herein by reference in its entirety.

Although the invention has been described with reference to particular embodiments and examples, it should be understood that various modifications can be made without departing from the spirit of the invention. The various parts of the disclosure including the abstract, summary, and the title are not to be construed as limiting the scope of the present invention, as their purpose is to enable the appropriate authorities, as well as the general public, to quickly determine the general nature of the invention. Unless the term "means" is expressly used, none of the features or elements recited herein should be construed as means-plus-function limitations. Accordingly, the invention is limited only by the claims.

What is claimed is:

1. A method of making a flexible strip of pouches of smokeless tobacco, the method comprising:

(a) combining portions of smokeless tobacco with a water-permeable wrapper;

(b) folding the wrapper around the portions to enclose the smokeless tobacco;

(c) sealing opposing edges of the wrapper with a lap seal to form pouches of smokeless tobacco; and (d) adhering the pouches of smokeless tobacco with a food-grade adhesive to a base tape to obtain a flexible strip of pouches of smokeless tobacco removably attached to the base tape;

wherein the base tape remains intact upon removal of individual pouches; and a side of the pouches opposite the base tape is free of a secondary wrapper.

2. The method of claim 1, wherein:

the sealing forms a flexible strip of pouches of smokeless tobacco separably joined in a serial relationship and sharing a unitary wrapping and wherein the lap-sealed edge is shared by individual pouches separably joined in a serial relationship; and optionally further comprising one or more steps selected from the group consisting of:

(1) die-cutting the wrapper to form rounded junctions between the individual pouches, the pouches having rounded corners;

(2) creating perforations in the wrapper between the individual pouches; and (3) combining the flexible strip of pouches of smokeless tobacco with a pocket-sized dispenser.

3. The method of claim 1, further comprising cutting the wrapper to produce individually-wrapped pouches.

4. The method of claim 1, wherein: (1) the pouches are suitable for placement in a mouth of a consumer immediately upon removal from the base tape; (3) the base tape comprises a visual indicator adapted to depict a quantity of pouches remaining before an end of the flexible strip.

5. The method of claim 1, wherein the base tape comprises the visual indicator, and the visual indicator:

(a) comprises a diagonally-extending line that is continuous or stepped;

(b) comprises two or more colors;

(c) comprises numerals; and/or (d) is provided only near the end of the base tape.

6. The method of claim 1, further comprising combining the flexible strip of pouches of smokeless tobacco with a pocket-sized dispenser, wherein:

(a) the dispenser comprises two or three pieces;
(b) the flexible strip is loose within the dispenser or the dispenser comprises a spiral form holding the flexible strip;
(c) the dispenser comprises a removable cover of an opening via which the flexible strip is dispensed, wherein the cover is optionally replaceable over the opening following dispensing;
(d) the dispenser comprises a protrusion adapted to aid a consumer in removing a pouch from the base tape; and/or
(e) the dispenser is adapted to receive base tape from which one or more pouches have been removed.

7. The method of claim 1, wherein the wrapper comprises one or more of a flavorant, a liner, softening agent, a browning inhibitor, or a coloring agent.

8. A method of making a flexible strip of portions of smokeless tobacco, the method comprising:
(a) forming portions of tobacco particles into units of a pre-portioned tobacco material;
(b) contacting the units of pre-portioned tobacco material with a multi-component aqueous coating solution comprising a water-soluble component and a cross-linkable polymer component which forms a substantially water-insoluble polymer upon cross-linking, to form a coating of on the units of pre-portioned tobacco material;
(c) cross-linking the cross-linkable polymer in the coating to form portions of smokeless tobacco comprising the units of pre-portioned tobacco material with a semi-dissolvable coating on the surface thereof, the semi-dissolvable coating comprising the water-soluble non-crosslinked component and the substantially water-insoluble cross-linked component;
(d) adhering the portions of smokeless tobacco to a base tape to obtain a flexible strip of portions of smokeless tobacco removably attached to the base tape;
wherein the base tape remains intact upon removal of individual pouches; and
a side of the pouches opposite the base tape is free of a secondary wrapper.

9. The method of claim 8, wherein the non-cross-linkable polymer included in an amount of about 15% to about 30% by weight based on the weight of the coating solution and the cross-linkable polymer which forms a substantially water-insoluble polymer upon cross-linking is included in an amount of about 0.3% to about 1.5% by weight based on the weight of the coating solution.

10. The method of claim 8, wherein: (1) the portions are suitable for placement in a mouth of a consumer immediately upon removal from the base tape; (3) the base tape comprises a visual indicator adapted to depict a quantity of portions remaining before an end of the flexible strip.

11. The method of claim 10, wherein the base tape comprises the visual indicator, and the visual indicator:
(a) comprises a diagonally-extending line that is continuous or stepped;
(b) comprises two or more colors;
(c) comprises numerals; and/or
(d) is provided only near the end of the base tape.

12. The method of claim 8, wherein:
the portions are free of a fabric and/or paper wrapper;
one of the polymers comprises a polysaccharide;
the portion is adapted to remain intact in a user's mouth or the portion is adapted to break up after insertion in the user's mouth; and
the portions optionally comprise a humectant and/or a flavorant.

13. The method of claim 8, further comprising combining the flexible strip of portions of smokeless tobacco with a pocket-sized dispenser, wherein:
(a) the dispenser comprises two or three pieces;
(b) the flexible strip is loose within the dispenser or the dispenser comprises a spiral form holding the flexible strip;
(c) the dispenser comprises a removable cover of an opening via which the flexible strip is dispensed, wherein the cover is optionally replaceable over the opening following dispensing;
(d) the dispenser comprises a protrusion adapted to aid a consumer in removing a portion from the base tape; and/or
(e) the dispenser is adapted to receive base tape from which one or more portions have been removed.

* * * * *